US009731879B2

(12) United States Patent
Sheldon et al.

(10) Patent No.: US 9,731,879 B2
(45) Date of Patent: Aug. 15, 2017

(54) CONTAINER LID WITH FUNCTIONAL ADDITIVE CHAMBERS

(71) Applicant: United States Gypsum Company, Chicago, IL (US)

(72) Inventors: Joshua D. Sheldon, Chicago, IL (US); Richard B. Stevens, Jr., Village of Lakewood, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 14/856,319

(22) Filed: Sep. 16, 2015

(65) Prior Publication Data

US 2016/0194123 A1 Jul. 7, 2016

Related U.S. Application Data

(60) Provisional application No. 62/099,761, filed on Jan. 5, 2015.

(51) Int. Cl.
*B65D 51/28* (2006.01)
*B65D 81/32* (2006.01)

(52) U.S. Cl.
CPC ..... *B65D 51/28* (2013.01); *B65D 51/2828* (2013.01); *B65D 81/3216* (2013.01)

(58) Field of Classification Search
CPC B65D 51/28; B65D 81/3216; B65D 51/2828; B65D 81/3222; B65D 51/2814; B65D 51/2821; B65D 51/2842; B65D 51/2835
USPC ..... 206/219, 222, 525
See application file for complete search history.

(56) References Cited

U.S. PATENT DOCUMENTS

| | | | | |
|---|---|---|---|---|
| 3,326,363 | A * | 6/1967 | Bennett | B65D 51/28 206/219 |
| 3,796,813 | A * | 3/1974 | Kurland | B65D 51/28 206/219 |
| 5,052,553 | A * | 10/1991 | De Sanctis | B65D 51/2814 206/219 |
| 5,431,276 | A * | 7/1995 | Lialin | B65D 51/2828 206/217 |
| 5,746,822 | A | 5/1998 | Espinoza et al. | |
| 6,228,163 | B1 | 5/2001 | Espinoza et al. | |
| 6,476,099 | B1 | 11/2002 | Cimaglio et al. | |
| 8,822,566 | B2 | 9/2014 | Hargrove et al. | |
| 2005/0178677 | A1 | 8/2005 | Morrow | |
| 2010/0307116 | A1 | 12/2010 | Fisher | |

(Continued)

FOREIGN PATENT DOCUMENTS

| | | |
|---|---|---|
| DE | 1482523 | 3/1969 |
| EP | 1655239 A1 | 10/2006 |

(Continued)

OTHER PUBLICATIONS

Derrien, International Search Report for PCT/US2015/067434, mailed Mar. 24, 2016.

*Primary Examiner* — Steven A. Reynolds
(74) *Attorney, Agent, or Firm* — Greer, Burns & Crain, Ltd.; Pradip Sahu; Phillip T. Petti

(57) ABSTRACT

A joint compound assembly is provided, including a main container with a base joint compound, and a container lid constructed and arranged for closing the main container, and having at least one sealed compartment enclosing a joint compound additive.

11 Claims, 5 Drawing Sheets

(56) References Cited

U.S. PATENT DOCUMENTS

| | | | | |
|---|---|---|---|---|
| 2011/0100844 | A1* | 5/2011 | Cimaglio | B65D 81/3266 206/219 |
| 2013/0161209 | A1* | 6/2013 | Hargrove | B65D 77/08 206/219 |

FOREIGN PATENT DOCUMENTS

| | | | |
|---|---|---|---|
| FR | 2915465 | A1 | 10/2008 |
| WO | 2009040146 | A1 | 4/2009 |
| WO | 2010137848 | A2 | 2/2010 |

* cited by examiner

CONTAINER LID WITH FUNCTIONAL ADDITIVE CHAMBERS

RELATED APPLICATION

This application claims priority based on 35 USC 119(e) from Provisional Application Ser. No. 62/099,761 filed Jan. 5, 2015.

BACKGROUND

The present invention relates generally to containers for multi-component compositions, and more specifically to a container for settable compositions, such as wallboard joint compound.

Walls and ceilings made from gypsum wallboard are conventionally constructed by attaching the wallboard panels to framing members or studs, and filling and coating the joints between the panels with a specially formulated paste composition called a joint compound. Joint compounds may be supplied as powdered compositions (to be mixed with water at the jobsite) or may be premixed with water at the factory to yield a ready mixed (or paste) joint compound. A paste joint compound (Taping grade) is placed within and over the joint formed by the abutting edges of the wallboard panels, and a paper reinforcing tape is embedded in the joint with the joint compound which is then permitted to dry. Alternately, the reinforcing tape may be of non-cellulose composition, but of a size and shape similar to strips of paper joint tape. Alternately, the reinforcing tape may be of a fiberglass weave requiring the use of chemically setting type joint compounds. When the joint compound is dry, a second joint compound (Topping or Finishing grade) is applied over the joint, and it too is permitted to dry. It is usually necessary for a third application of a joint compound and, after the third coat is dry, it may be lightly sanded and may be conventionally finished with a decorative material (paint, texture or wallpaper) then applied to the wall. All three coats of joint compound may alternately be done with an All Purpose grade of joint compound.

Ready mixed joint compound is typically supplied to the customer in either cardboard cartons or plastic pails in units typically with volumes of 3.5 to 4.5 gallons (13.25-17.03 L) for large applications, or 1 to 3.5 quarts (0.95-3.31 L) for smaller applications. Joint compound is supplied at a viscosity typically higher than what is applied at the jobsite. This allows the contractor to mix in additional water using a power drill and mixing paddle to achieve the desired application viscosity.

Ready Mix joint compound production is typically accomplished by blending the wet and dry ingredients in a mixer until smooth, adjusting the viscosity to a desired level through water addition, then filling and sealing containers to be shipped to customers. This process can be disrupted by use of ingredients which thicken very rapidly and take longer periods of time to fully wet out and drop in viscosity, leaving the combined wet and dry ingredients in the mixer competing for water through the typical mixing cycle and at a higher than desired viscosity. The above process results in mechanical limitations and problems such as binding of the wet mixer and overloading of the mixer motor. The higher than desired viscosity at the completion of the mixing cycle affects the ease of pumping and moving the material out of the mixing system and through the packaging line and also interferes with the lidding and closing of the container.

Thus, there are mechanical limitations on the types of raw materials that can be used within a typical wet mixing system for manufacturing ready mix. Depending on the particular product requirements, including long pre-use shelf life, fast setting, low viscosity of application and others, several options have been proposed to provide joint compounds with separated additives that enable the user to obtain enhanced or more desirable joint compound performance characteristics when the mixture is finalized just prior to application. U.S. Pat. No. 6,476,099, incorporated by reference, discloses the addition of surfactant additives to joint compound to generate performance with improved cracking, improved shrinkage and reduction of surface finish defects after application to wallboard surfaces. U.S. Pat. Nos. 6,228,163 and 5,746,822 also incorporated by reference, disclose joint compounds formulated with a base joint compound that is relatively inert until an extra additive is provided, functionally serving as an activator.

U.S. Pat. No. 8,822,566, incorporated by reference, discloses providing a nonhomogeneous formulation of an additive with a ready mix base joint compound for ultimate mixing by the user on the jobsite.

SUMMARY

The above-identified need is met with the present container, including a main cavity constructed and arranged for retaining a supply of base joint compound, and a reclosable lid for the container. A feature of the lid is at least one frangible sealed additive chamber constructed and arranged for retaining a supply of additive designed to enhance or modify the performance or the base joint compound. The number, shape and dimensions of each chamber on the lid may vary to suit the situation. A peelable seal is provided over an open end of the chamber so that the additive contents are maintained separated from the base joint compound in the container until mixing is desired by the user. Contemplated additives suitable for separate packaging in the present water soluble containers include, but are not limited to retarders, accelerators, activators, dust reducers, pigments, adhesion promoters and the like.

It is contemplated that either the base joint compound or additive may be dry powder or an aqueous composition. In one embodiment, the chambers are open on an upper surface of the lid. Peelable foil or plastic membranes seal open ends of the chambers. Prior to mixing, the user peels off the seal and inverts the lid so that the chambers open into the open container, allowing mixing of the additive with the base joint compound.

In another embodiment, the chambers open towards a lower end facing the base joint compound within the container. Prior to mixing, the user opens the lid, peels the foil to expose the additive and then replaces the lid so that the additive pours into the base joint compound in the container.

In still another embodiment, usable with either of the first two embodiments, includes providing the chamber with a frangible zone. The zone is constructed and arranged to be easily breached with a sharp object, such as a screwdriver or the like. When mixing is desired, the user manipulates the sharp object so that the frangible zone in at least an upper or a lower wall of the chamber, or the zone and a peelable seal are both pierced, permitting escape of the additive into the main container so that mixing is achieved with the base joint compound.

In embodiments when the additive is an activator for the base joint compound, multiple chambers are contemplated having separate doses of the same activator. Thus, by selecting the number of chambers to be opened, the user controls the activation time of the ultimately mixed joint compound. For example, opening a single chamber results in activation in 40 minutes, and opening two chambers results in activation in 15 minutes. The number of chambers, the size and volume of the chambers, and the amounts of additives within each chamber can be varied, and therefore the time values of activation may also be varied and tailored to the application.

More specifically, a joint compound assembly is provided, including a main container with a base joint compound, and a container lid constructed and arranged for closing the main container, and having at least one sealed compartment enclosing a joint compound additive.

In another embodiment, a container and lid assembly is provided, including a main container with a base joint compound, and a container lid constructed and arranged for closing the main container, and having a plurality of sealed compartments enclosing a joint compound additive. Each sealed compartment has one of a removable sealed open end and a frangible zone promoting puncture for maintaining premixing isolation and facilitating mixing of respective contents of the main container and the chambers.

DETAILED DESCRIPTION

Figure 1:
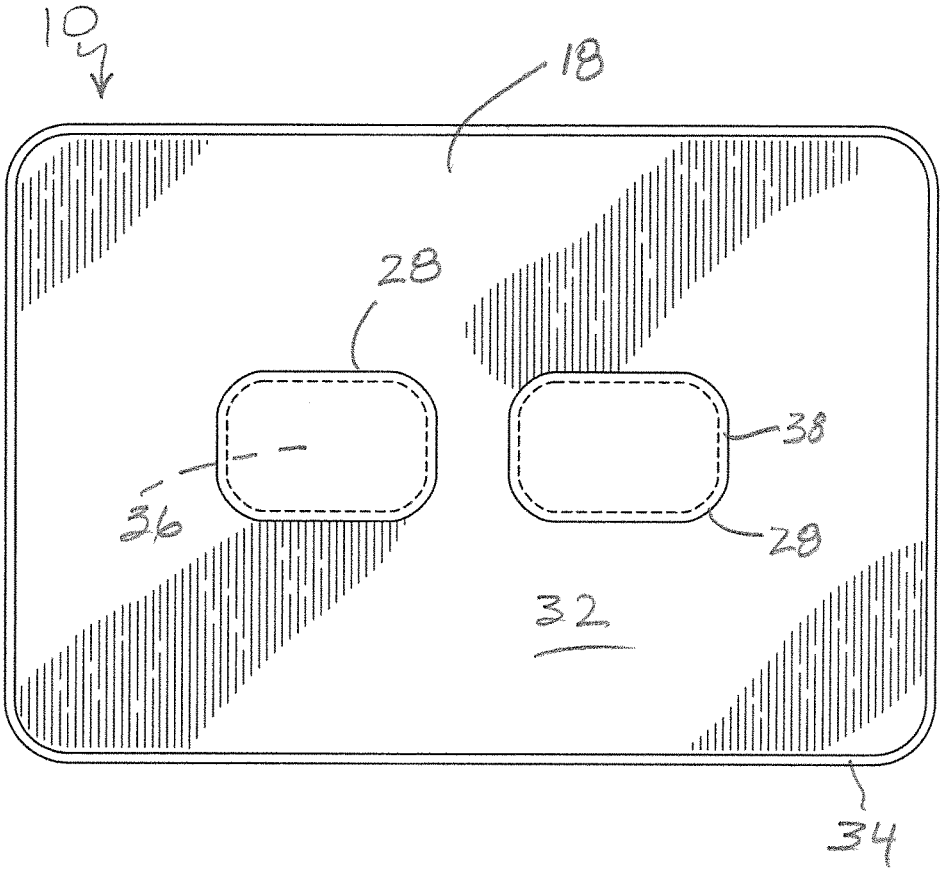
FIG. 1 is a plan view of the present lid having two chambers.

Referring to FIGS. 1-3B, the present container, generally designated 10, is of the general type used to package ready mix wallboard joint compound, and includes a housing 12 having a peripheral sidewall 14, a bottom 16 and a removable lid 18. As is well known in the art, the container 10 is preferably made of plastic and the housing 12 is molded or formed in one piece; however, other suitable self-supporting, water-resistant or waterproof materials, including coated cardboard and the like are contemplated. A main cavity 20 is defined by the sidewall 14, the bottom 16 and an upper edge 22 of the housing 12 and is constructed and arranged for retaining a supply of base joint compound 24. A radially projecting lip 26 attached to the peripheral sidewall 14 provides an anchoring point for formations on the lid 18, as is well known in the art.

A feature of the removable, reclosable lid 18 is at least one frangible sealed additive chamber 28 constructed and arranged for retaining a supply of additive 30 designed to enhance or modify the performance of the base joint compound 24. The number, shape and dimensions of each chamber 28 on the lid 18 may vary to suit the situation. In the present container 10, the additive 30 is preferably taken from the group consisting of retarders, accelerators, activators, pigments, adhesion promoters and dust reducers. However, other additives 30 are contemplated, as well as each chamber potentially containing different additives.

In the preferred embodiment, the chambers 28 are integrally molded into the lid 18, and more specifically, depend from an underside 31 of a generally horizontal top surface 32, which is bordered by a depending skirt 34. In some containers 10, the skirt 34 is provided with a clip or hook formation (not shown) for engaging the lip 26 to maintain the container 10 in a closed condition.

Figure 2:
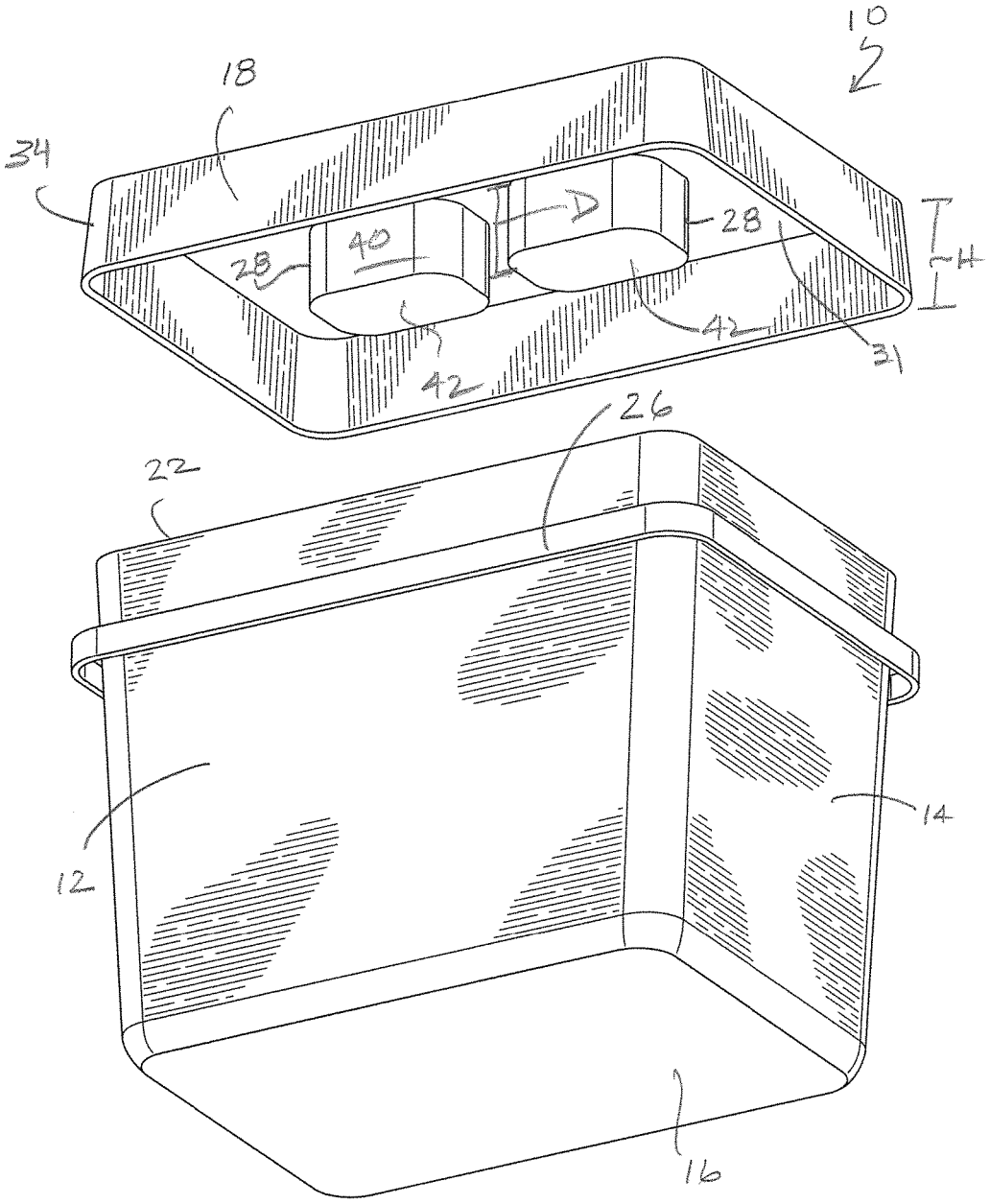
FIG. 2 is an exploded perspective view of the present lid shown above a container.
Figure 3A:
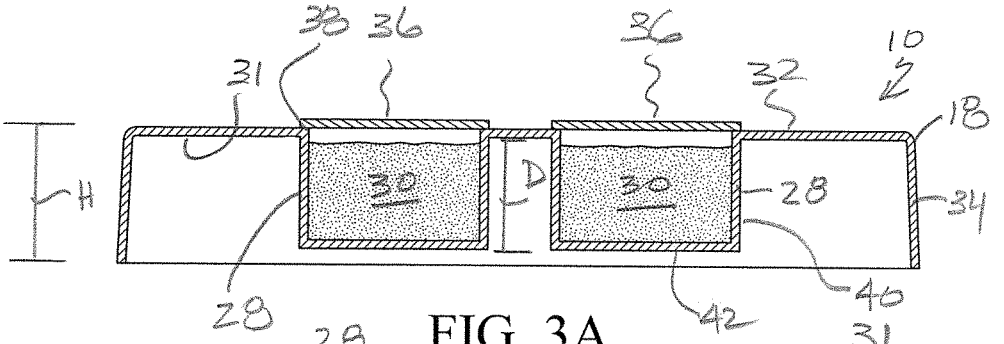
FIG. 3A is a cross-section taken along the line 3-3 of FIG. 1 and in the direction indicated with the chambers sealed.
Figure 3B:
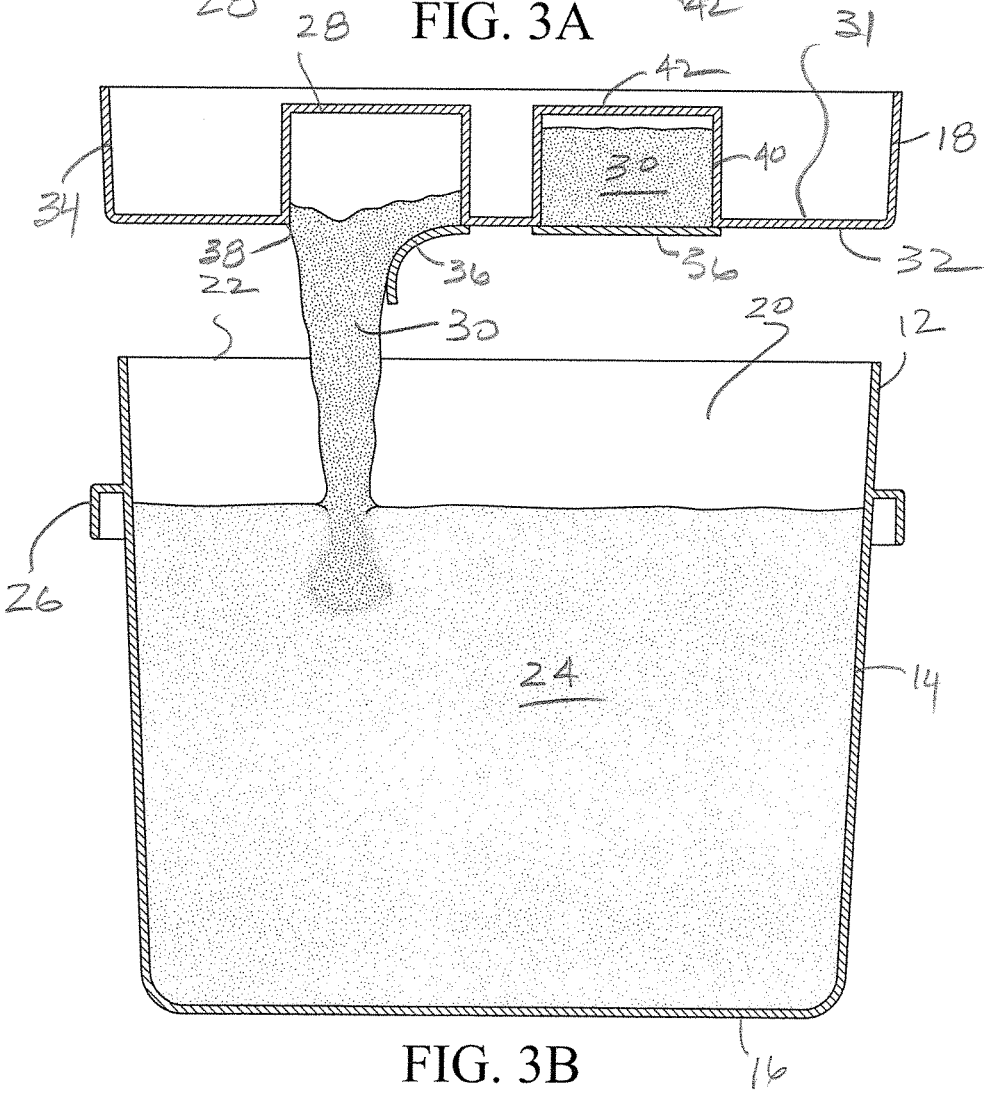
FIG. 3B is a cross-section of the lid of FIG. 3A with one chamber opened and being poured into a main container.

Referring to FIGS. 2 and 3A, the additive chambers 28 depend from the top surface 32 a distance "D" which is less than a height "H" of the skirt 34. However, other relative dimensions are contemplated. Also, while only two such chambers 28 are shown, the number of chambers may vary to suit the application. A peelable or otherwise removable seal 36 of foil, thin plastic membrane or the like is provided over at least one opening, such as an open end 38 of the chamber 28 so that the additive contents 30 are maintained separated from the base joint compound 24 in the container 10 until mixing is desired by the user. Such separation is particularly important when the additive 30 is a dry powder, and the main joint compound 24 is a moist, settable mixture. While the open end 38 of the chamber 28 is associated with the top lid surface 32 in FIGS. 1-3A, it is also contemplated that the open end could be another surface on the chamber, including a peripheral wall 40 or a floor 42.

It is contemplated that either the base joint compound 24 or the additive 30 may be dry powder or an aqueous composition. As seen in FIG. 3A, prior to mixing, the user removes the lid 18 from the housing 12, peels off the seal 36 and inverts the lid so that the chambers 28 open into the main cavity 20, allowing mixing of the additive 30 with the base joint compound 24. As is known in the art, the mixing may be by hand using a trowel or the like, or using a powered mixer, such as a power drill with a special mixer bit (not shown). When the lid 18 is provided with multiple chambers 28, and the chambers are supplied with the same additive 30, such as an accelerator, the user can control the performance of the joint compound 24, in this case the setting rate, by deciding to add more or less accelerator, by the number of chambers 28 that are opened. For example, opening a single chamber 28 results in activation in 40 minutes, and opening two chambers results in activation in 15 minutes. The number of chambers 28 and the time values of activation may vary with the application.

Figure 4A:
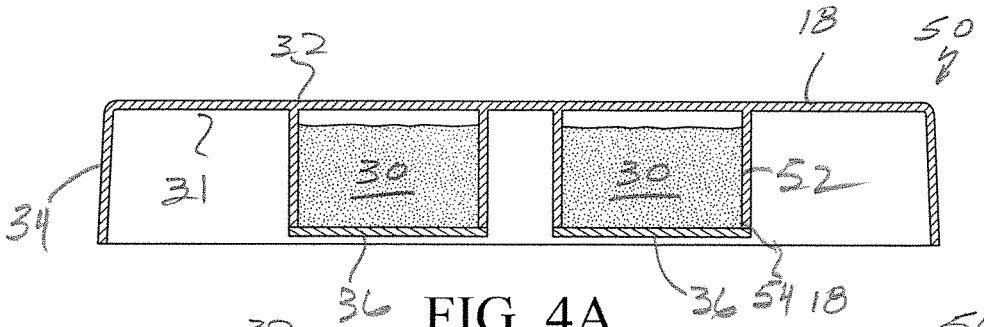
FIG. 4A is a cross-section similar to FIG. 3A but of an alternate embodiment of the present lid with the chambers sealed.
Figure 4B:
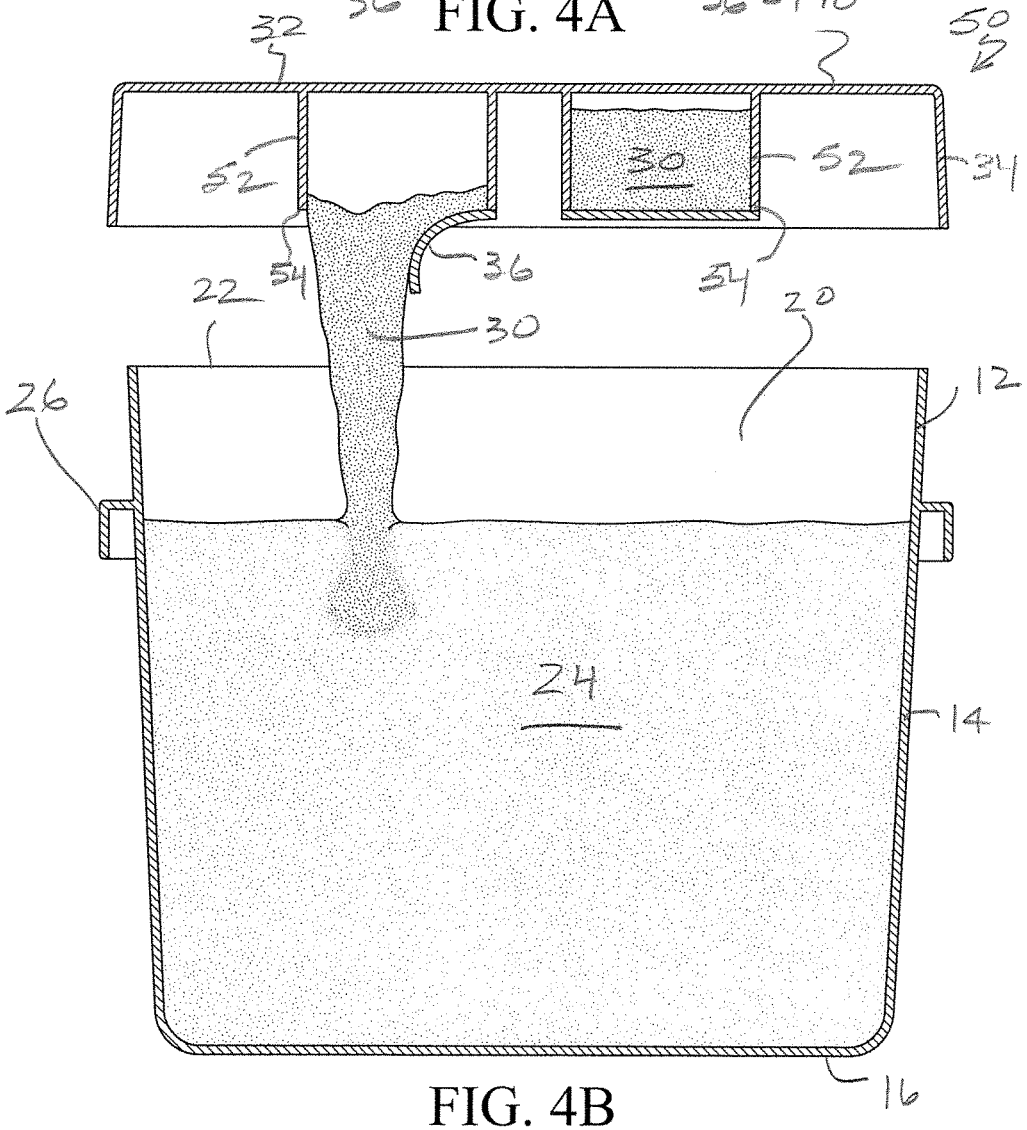
FIG. 4B is a cross-section of the lid of FIG. 4A but with one chamber opened and being poured into the container.

Referring now to FIGS. 4A and 4B, another embodiment of the present container 10 is generally designated 50. Components shared with the container 10 are designated with identical reference numbers. A main feature of the container 50 is that additive chambers 52 have open ends 54 facing towards the base joint compound 24 within the main cavity 20. In this embodiment, prior to mixing, the user opens the lid 18, peels the seal 36 to expose the additive 30, and then replaces the lid so that the additive pours into the base joint compound in the container 50.

Figure 5A:
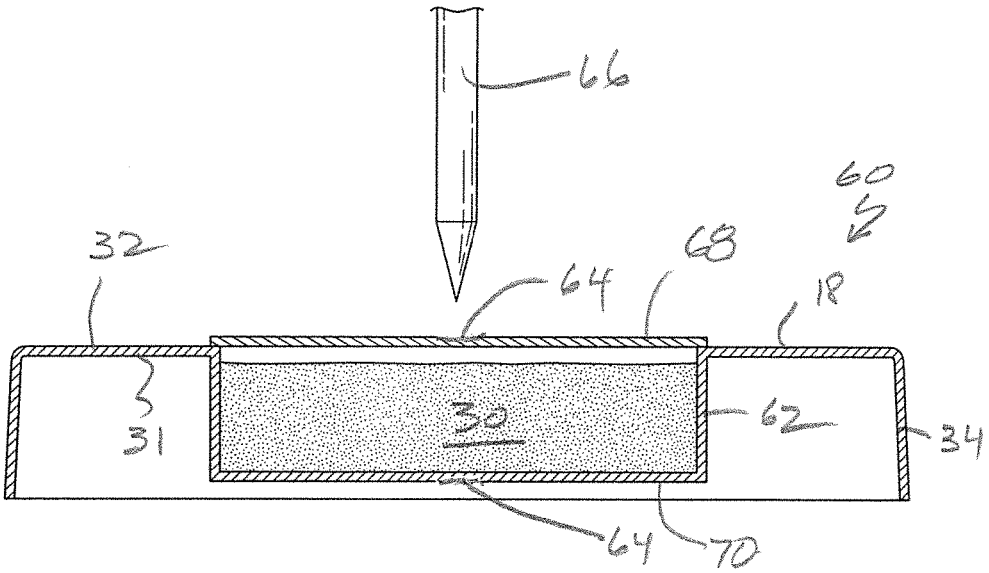
FIG. 5A is a cross-section similar to FIG. 3A of still another embodiment of the present lid with the chambers sealed.
Figure 5B:
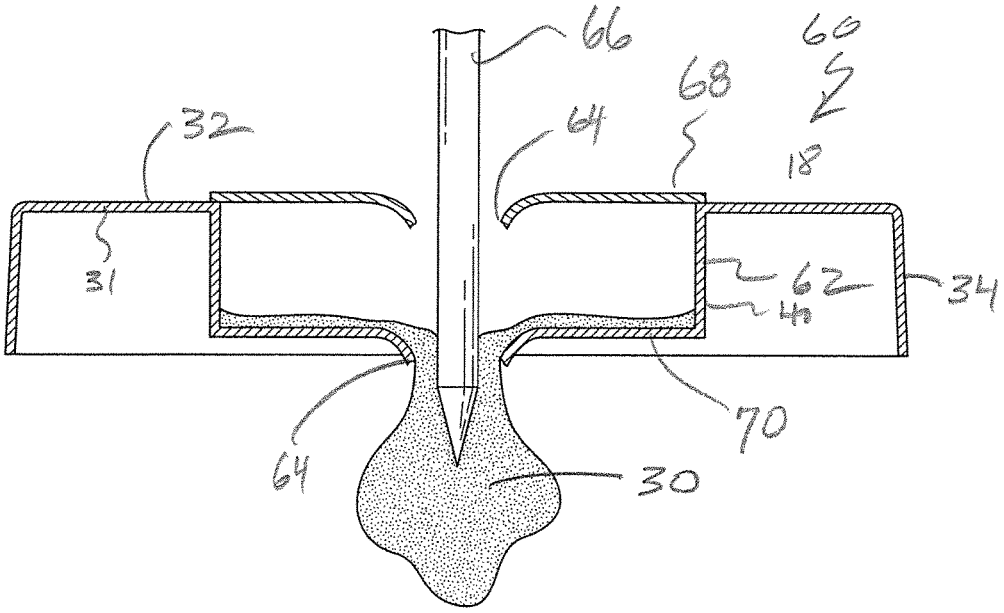
FIG. 5B is a cross-section of the lid of FIG. 5B with one chamber opened and the contents being mixed with the contents of the container.

Referring now to FIGS. 5A and 5B, still another embodiment of the present container is depicted, generally designated 60. Components shared with the containers 10 and 50 are designated with identical reference numbers. Usable with either of the first two embodiments 10 and 50, the container 60 provides an additive chamber 62 with a frangible zone 64 instead of the peelable seal 36. The frangible zone 64 is constructed and arranged to be thinned, scored, or the like to be easily breached with a sharp object 66, such as a screwdriver or similar tool. When mixing is desired, the user manipulates the sharp object 66 so that the frangible zone 64, in an upper surface 68 and a lower surface 70 are both pierced, permitting escape of the additive 30 into the main cavity 20 of the container 60 so that mixing is achieved with the base joint compound 24. The frangible zone 64 is preferably visually distinguishable on the lid 18, as by an integrally molded arrow, "X" or the like, so that the user can readily locate it for piercing. Alternately, one of the surfaces 68, and 70 may be replaced with the peelable seal 36.

While a particular embodiment of the present container lid with functional additive chambers has been described herein, it will be appreciated by those skilled in the art that changes and modifications may be made thereto without departing from the invention in its broader aspects and as set forth in the following claims.

The invention claimed is:

1. A joint compound assembly, comprising:

a main container with a base joint compound; and a container lid constructed and arranged for closing said main container, and having at least one sealed compartment enclosing a joint compound additive, said container lid has a generally horizontal top surface bordered by a depending skirt configured for engaging said main container, an underside opposite said top surface, said at least one sealed compartment depends from said underside in a same direction as said skirt, and has an opening associated with said top surface and being sealed by a seal accessible from said top surface so that said lid is inverted for mixing the additive with the base joint compound.

2. The joint compound assembly of claim 1, wherein said seal is frangible.

3. The joint compound assembly of claim 1, wherein said seal is peelable.

4. The joint compound assembly of claim 1, wherein said additive is taken from the group consisting of retarders, accelerators, activators, pigments, adhesion promoters and dust reducers.

5. The joint compound assembly of claim 1 wherein said container lid has a frangible zone in registry with a frangible seal of said at least one sealed compartment, such that said compartment is pierceable from an upper side of said lid.

6. The joint compound assembly of claim 1, further including a plurality of said at least one sealed compartments, each constructed and arranged for storing amounts of the same additive, thus allowing for adjustment of the amount of the additive to be combined with the base joint compound.

7. A container and lid assembly, comprising:

a main container with a base joint compound; and a container lid constructed and arranged for closing said main container, and having a plurality of sealed compartments, each said sealed compartment enclosing a joint compound accelerator, said container lid has a generally horizontal top surface bordered by a depending skirt configured for engaging said main container, an underside opposite said top surface, each said sealed compartment depends from said underside in a same direction as said skirt, each said sealed compartment having one of a removable sealed open end and a frangible zone promoting puncture for maintaining premixing isolation and facilitating mixing of respective contents of said main container and said sealed compartments, regulation of a setting time of said base joint compound being dependent on how many of said plurality said sealed compartments are punctured.

8. The container and lid assembly of claim 7, wherein said removable sealed open end is located on at least one of an upper and a lower surface of said sealed compartments.

9. The joint compound assembly of claim 1, wherein said at least one sealed compartment depends from said underside a distance which is less than a height of said skirt.

10. The container and lid assembly of claim 7, wherein said sealed compartments depend from said underside a distance which is less than a height of said skirt.

11. The container and lid assembly of claim 7, and wherein each said sealed compartment has an opening associated with said top surface and being sealed by a seal accessible from said top surface so that said lid is inverted for mixing the additive with the base joint compound.

* * * * *